US008641104B1

(12) United States Patent
Tien

(10) Patent No.: US 8,641,104 B1
(45) Date of Patent: Feb. 4, 2014

(54) LATCH DEVICE WITH A CLUTCH FUNCTION

(71) Applicant: Hung-Jen Tien, Tainan (TW)

(72) Inventor: Hung-Jen Tien, Tainan (TW)

(73) Assignee: I-Tek Metal MFG. Co., Ltd., Tainan (TW)

( * ) Notice: Subject to any disclaimer, the term of this patent is extended or adjusted under 35 U.S.C. 154(b) by 0 days.

(21) Appl. No.: 13/742,710

(22) Filed: Jan. 16, 2013

(51) Int. Cl.
*E05B 63/04* (2006.01)

(52) U.S. Cl.
USPC ..... 292/244

(58) Field of Classification Search
USPC ..... 292/163, 196, 244, 336; 70/107
See application file for complete search history.

(56) References Cited

U.S. PATENT DOCUMENTS

| | | | | | |
|---|---|---|---|---|---|
| 4,118,056 | A * | 10/1978 | Alexander | 292/169.17 |
| 4,583,382 | A * | 4/1986 | Hull | 70/107 |
| 4,950,005 | A * | 8/1990 | Cudd | 292/150 |
| 5,678,870 | A * | 10/1997 | Pelletier | 292/244 |
| 5,820,177 | A * | 10/1998 | Moon | 292/335 |
| 6,354,121 | B1 * | 3/2002 | Frolov | 70/277 |
| 6,581,423 | B2 * | 6/2003 | Lin | 70/107 |
| 6,993,946 | B1 * | 2/2006 | Shen | 70/472 |
| 7,377,140 | B2 * | 5/2008 | Shen et al. | 70/107 |
| 7,497,486 | B1 * | 3/2009 | Davis et al. | 292/32 |
| 7,603,880 | B2 * | 10/2009 | Chen | 70/107 |
| 7,698,918 | B2 * | 4/2010 | Geringer et al. | 70/278.7 |
| 8,199,011 | B2 * | 6/2012 | Lu | 340/542 |
| 8,292,336 | B2 * | 10/2012 | Moon | 292/61 |
| 8,424,935 | B2 * | 4/2013 | Moon | 292/244 |
| 2003/0127864 | A1 * | 7/2003 | Dalsing | 292/169.14 |
| 2005/0212301 | A1 * | 9/2005 | Huang | 292/169.14 |
| 2006/0087125 | A1 * | 4/2006 | Moon et al. | 292/32 |
| 2009/0145179 | A1 * | 6/2009 | Chen | 70/107 |
| 2010/0140962 | A1 * | 6/2010 | Kim | 292/165 |
| 2010/0263418 | A1 * | 10/2010 | Moon | 70/107 |

* cited by examiner

*Primary Examiner* — Thomas A. Beach
*Assistant Examiner* — Thomas Neubauer
(74) *Attorney, Agent, or Firm* — Alan Kamrath; Kamrath IP Lawfirm, P.A.

(57) ABSTRACT

A latch device (14) includes a latch bolt (30) movable between a latching position and an unlatching position. A sleeve (775) is mounted to an outer side (13A) of a door (11) and operatively connected to an outer operational device (12). A clutch (575) is mounted to and jointly movable with the sleeve (775). An unlatching member (711) is operably connected to the latch bolt (30) and releasably engaged with the clutch (575). When the unlatching member (711) engages with the clutch (575), operation of a handle (502) of the outer operational device (12) retracts the latch bolt (30). When the unlatching member (711) disengages from the clutch (575), the latch bolt (30) remains in the latching position if the handle (502) is rotated.

5 Claims, 10 Drawing Sheets

LATCH DEVICE WITH A CLUTCH FUNCTION

BACKGROUND OF THE INVENTION

The present invention relates to a latch device and, more particularly, to a latch device including a clutch function to avoid damage to components of an outer operational device of a lock.

Various door locks have been developed according to differing needs in different places. One type of the door lock includes a latch device mounted between inner and outer sides of a door and having a latch. An outer operational device is mounted to the outer side of the door and operatively connected to the latch device. The outer operational device includes a handle for retracting the latch from a latching position to an unlatching position. The handle can not be pivoted when the latch device is in a locked state for burglarproof or curfew purposes. However, components of the outer operational device are liable to deform or damage if the handle is forcibly pivoted while the latch device is in the locked state. The problem is aggravated if the handle is in the form of a lever that amplifies the force applied to the lever.

Thus, a need exists for a latch device with a clutch function to avoid damage to the components of the outer operational device of a lock.

BRIEF SUMMARY OF THE INVENTION

The present invention solves this need and other problems in the field of door locks with a clutch function by providing a latch device including a case adapted to be mounted in a compartment in a door. The case includes a lateral wall and a space delimited by the lateral wall. A first peg and a second peg are formed on the lateral wall and located in the space. The lateral wall further includes a sleeve hole located between the first and second pegs. A latch bolt is received in the space and includes a retractor and a head operatively connected to the retractor. The head is slideable along a first axis between a latching position outside of the case and an unlatching position in the case. The head is biased from the unlatching position to the latching position A rocker includes a pivotal portion and a connection portion. The rocker further includes a pin, with the pivotal portion located between the pin and the connection portion. The pivotal portion of the rocker is pivotably mounted to the first peg of the case. A follower is pivotably connected to the first peg of the case. The follower includes a projection and an engagement portion. The connection portion of the rocker is pivotably connected to the engagement portion of the follower. The follower is pivotable between a first position and a second position about a second axis perpendicular to the first axis. The follower is adapted to be driven by an actuating plate of a cylinder of an outer operational device mounted to an inner side of the door. The follower pivots between the first and second positions when the actuating plate presses against the projection or the engagement portion.

A connection member is slideably received in the space of the case. The connection member includes upper and lower ends spaced from each other along a third axis perpendicular to the first and second axes. The connection member further includes a slot between the upper and lower ends. The pin of the rocker is slideably received in the slot of the connection member. The connection member moves between an upper position and a lower position along the third axis when the rocker pivots. A seat is mounted in the space of the case and includes first and second sides spaced from each other along the second axis. A receiving hole extends from the first side through the second side of the seat. The receiving hole of the seat aligns with the sleeve hole of the case.

A push block includes inner and outer faces spaced from each other along the second axis. An axial hole extends from the inner face through the outer face of the push block. A push portion is formed on the inner face of the push block. The push block is located between the seat and the lateral wall of the case. The axial hole of the push block aligns with the sleeve hole of the case. The push block is pivotable between an engagement position and a disengagement position when the connection member moves between the upper and lower positions.

A sliding block is slideably received in the receiving hole of the seat and includes first and second faces spaced from each other along the second axis. An engagement portion is formed on the second face of the sliding block. The engagement portion of the sliding block engages with the push portion of the push block. The sliding block is movable between a front position and a rear position along the second axis. The sliding block is in the rear position when the push block is in the disengagement position. The sliding block is in the front position when the push block is in the engagement position.

A clutch is received in the receiving hole of the seat and releasably engaged with the sliding block. The clutch includes first and second sides spaced from each other along the second axis. An actuation hole extends from the first side through the second side of the clutch. An unlatching member includes outer and inner sides spaced from each other along the second axis. An insertion groove extends from the outer side through the inner side of the unlatching member. A pivotal hole extends from the outer side through the inner side of the unlatching member. The unlatching member further includes an outer periphery extending between the outer and inner sides of the unlatching member. A push leg is formed on the outer periphery of the unlatching member. The insertion block of the clutch engages with the insertion groove of the unlatching member when the sliding block is in the front position. The insertion block of the clutch disengages from the insertion groove of the unlatching member when, the sliding block is in rear position.

A sleeve engages with and is jointly pivotable with the clutch. The sleeve includes first and second sections spaced from each other along the second axis and an intermediate portion between the first and second sections. The second section of the sleeve is pivotably received in the sleeve hole of the case. The intermediate portion of the sleeve is pivotably received in the axial hole of the push block and the throughhole of the sliding block. The intermediate portion of the sleeve engages with the actuation hole of the clutch to allow joint pivotal movement of the sleeve and the clutch. The first section of the sleeve is pivotably connected to the unlatching member. The sleeve is adapted to be operatively connected to a linking rod of an outer operational device mounted to an outer side of the door. The outer operational device has a handle. The sleeve is adapted to pivot through transmission by the linking rod when the handle pivots.

A driving rod is pivotably received in the space and includes an actuation end operatively connected to the retractor. The driving rod further includes a pivotal end pivotably mounted to the second peg of the case. The push leg of the unlatching member abuts the driving rod. The driving rod is pushed by the push leg to move the retractor when the unlatching member pivots.

When the follower is in the first position, the connection member is in the lower position, the push block is in the engagement position, and the sliding block is in the front position. The insertion block of the clutch engages with the insertion groove of the unlatching member. If the sleeve pivots and causes pivotal movement of the unlatching member, the driving rod pivots to retract the retractor, moving the head of the latch bolt from the latching position to the unlatching position.

When the follower in the second position, the connection member is in the upper position, the push block is in the disengagement position, and the sliding block is in the rear position. The insertion block of the clutch disengages from the insertion groove of the unlatching member. The unlatching member is not moved when the sleeve pivots, retaining the head of the latch bolt in the latching position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
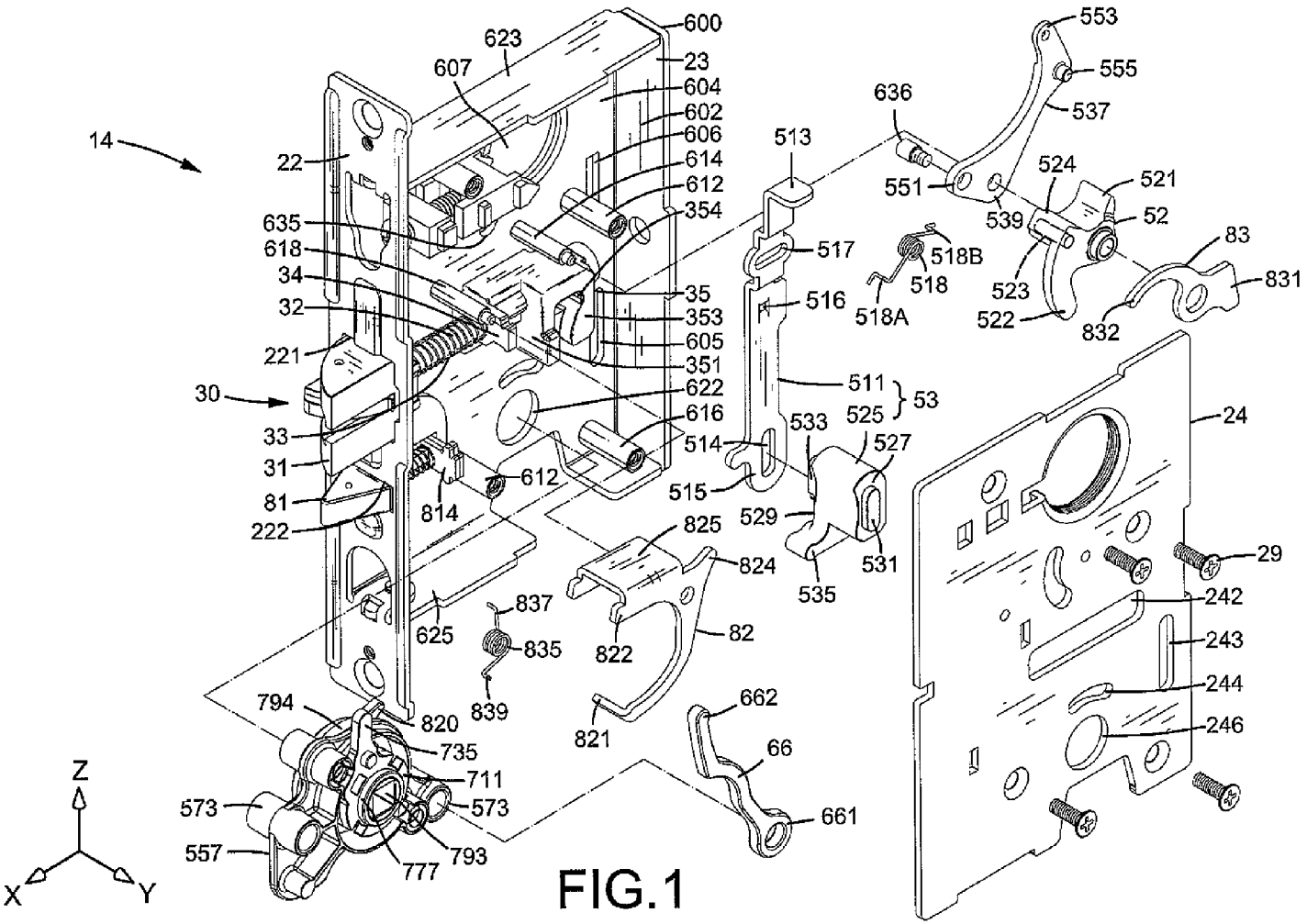
FIG. 1 shows an exploded, perspective view of a latch device according to the present invention.
Figure 2:
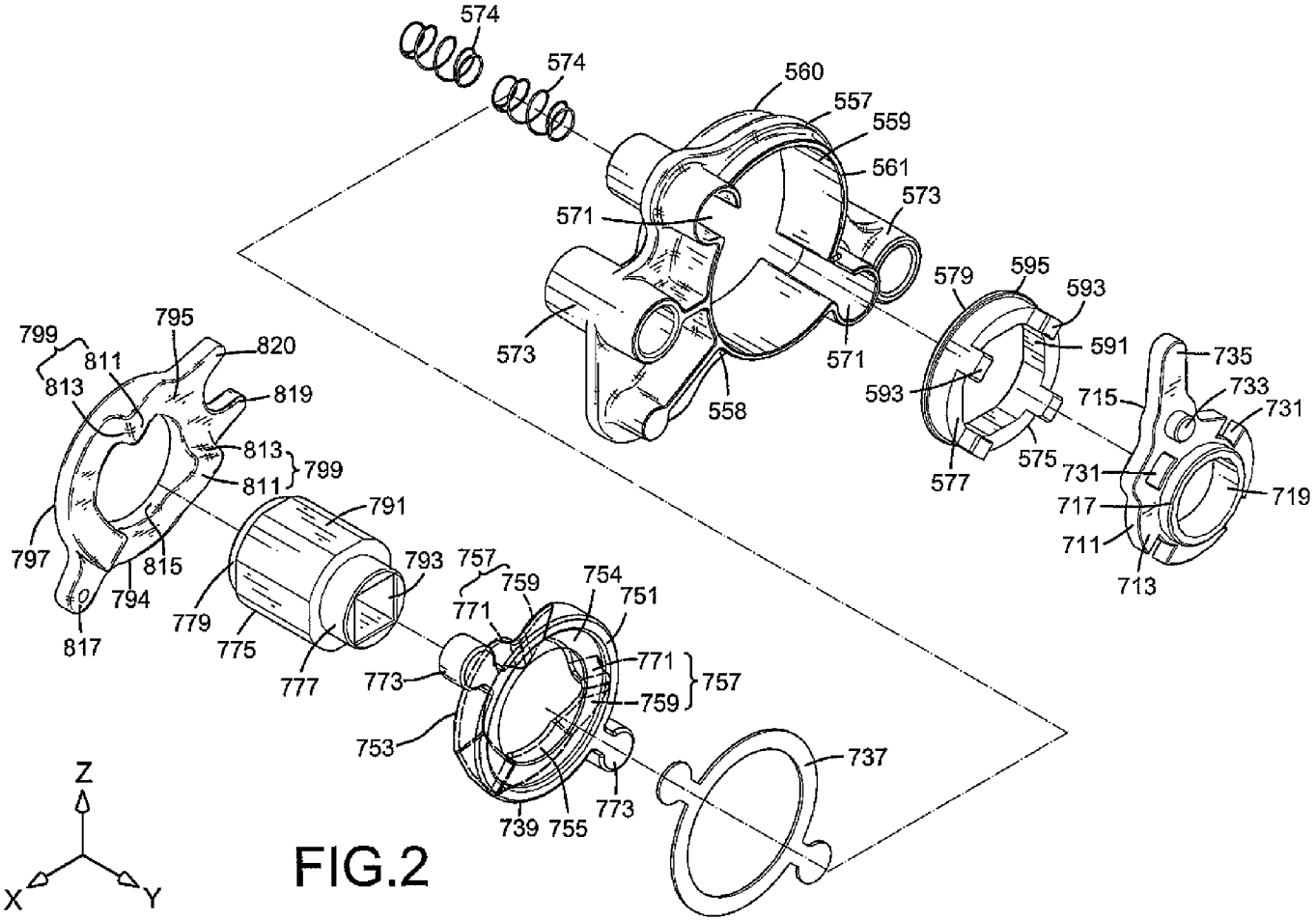
FIG. 2 shows an exploded, perspective view of a portion of the latch device of FIG. 1.
Figure 3:
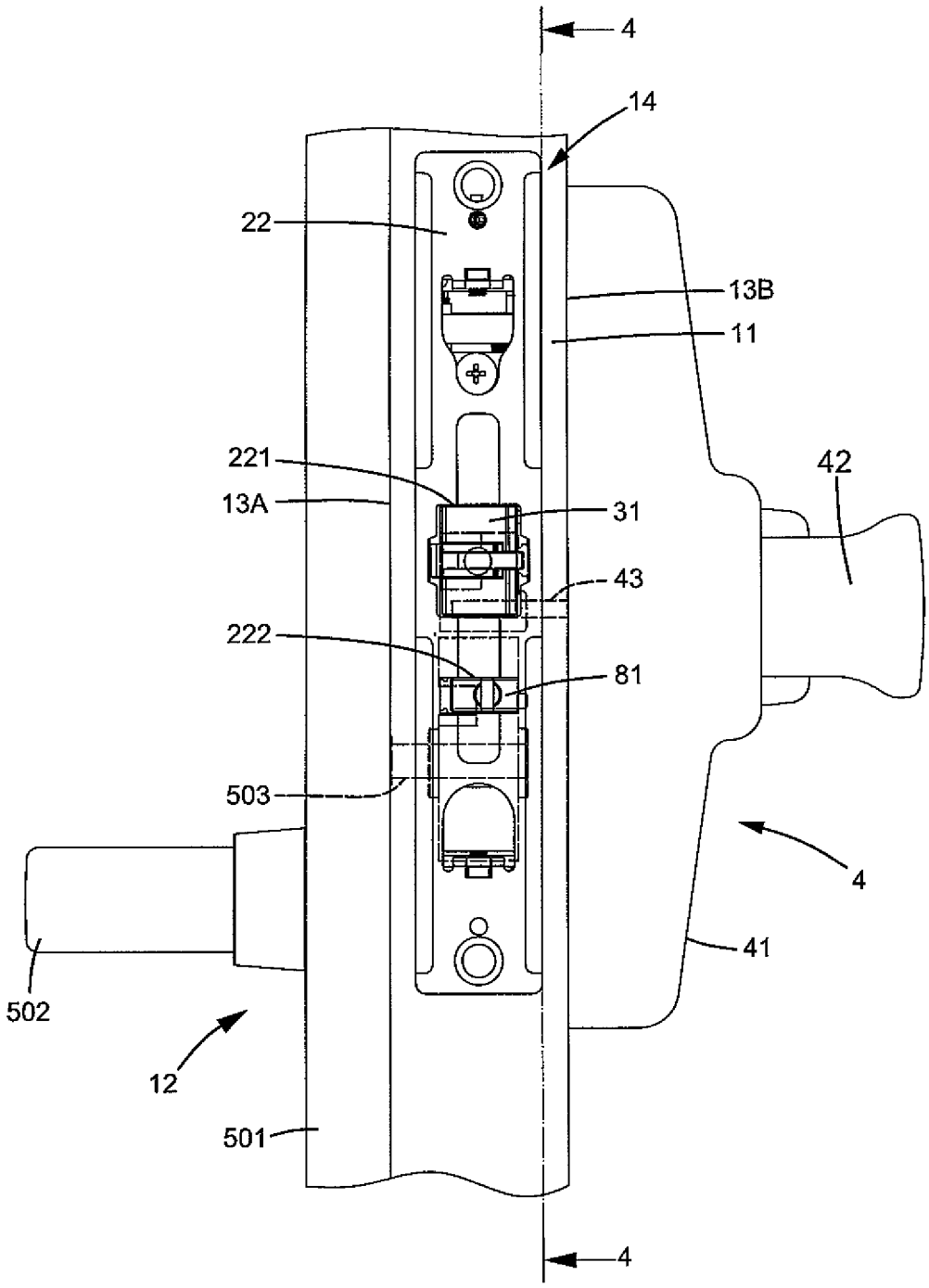
FIG. 3 shows a side view of the latch device, a door to which the latch device is mounted, and an outer operational device.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "inner", "outer", "end", "portion", "section", "circumferential", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A latch device is shown in the drawings and generally designated 14. According to the form shown, latch device 14 includes a substantially parallelepiped-shaped case 600 having a faceplate 22 and a rear wall 23 spaced from faceplate 22 along a first axis X. Case 600 further includes a lateral wall 604 extending between first edges of faceplate 22 and rear walls 23. Case 600 further includes a lid 24 removably mounted to second edges of faceplate 22 and rear walls 23. Lid 24 is spaced from lateral wall 604 along a second axis Y perpendicular to first axis X. Case 600 further includes upper and lower walls 623 and 625 spaced along a third axis Z perpendicular to first and second axes X and Y. Faceplate 22, rear wall 23, lid 24, lateral wall 604, and upper and lower walls 623 and 625 together form case 600 and define a space 602. Lateral wall 604 includes first and second guiding slots 605 and 606 spaced along third axis Z, with each of the first and second guiding slots 605 and 606 extending from an inner face through an outer face of lateral wall 604 along second axis Y. First guiding slot 605 is located below second guiding slot 606 along third axis Z. Lateral wall 604 includes a sleeve hole 622, an arcuate slot 635, and a mounting hole 607, with each of the sleeve hole 622, arcuate slot 635, and the mounting hole 607 extending from the inner face through the outer face of lateral wall 604. Case 600 further includes a plurality of engagement pegs 612 extending from the inner face of lateral wall 604 along second axis Y. Each engagement peg 612 has a screw hole. Furthermore, first, second, and third pegs 614, 616, and 618 are formed on the inner face of lateral wall 604 and extend along second axis Y. First peg 614 is spaced from second guiding slot 606 along first axis X. Second peg 616 is spaced from first guiding slot 605 along third axis Z. Third peg 618 is slightly below first peg 614 along third axis Z and spaced from first peg 614 along first axis X. Faceplate 22 includes first and second openings 221 and 222, with each of the first and second openings 221 and 222 extending from an outer face of faceplate 22 to space 602 along first axis X.

Figure 6:
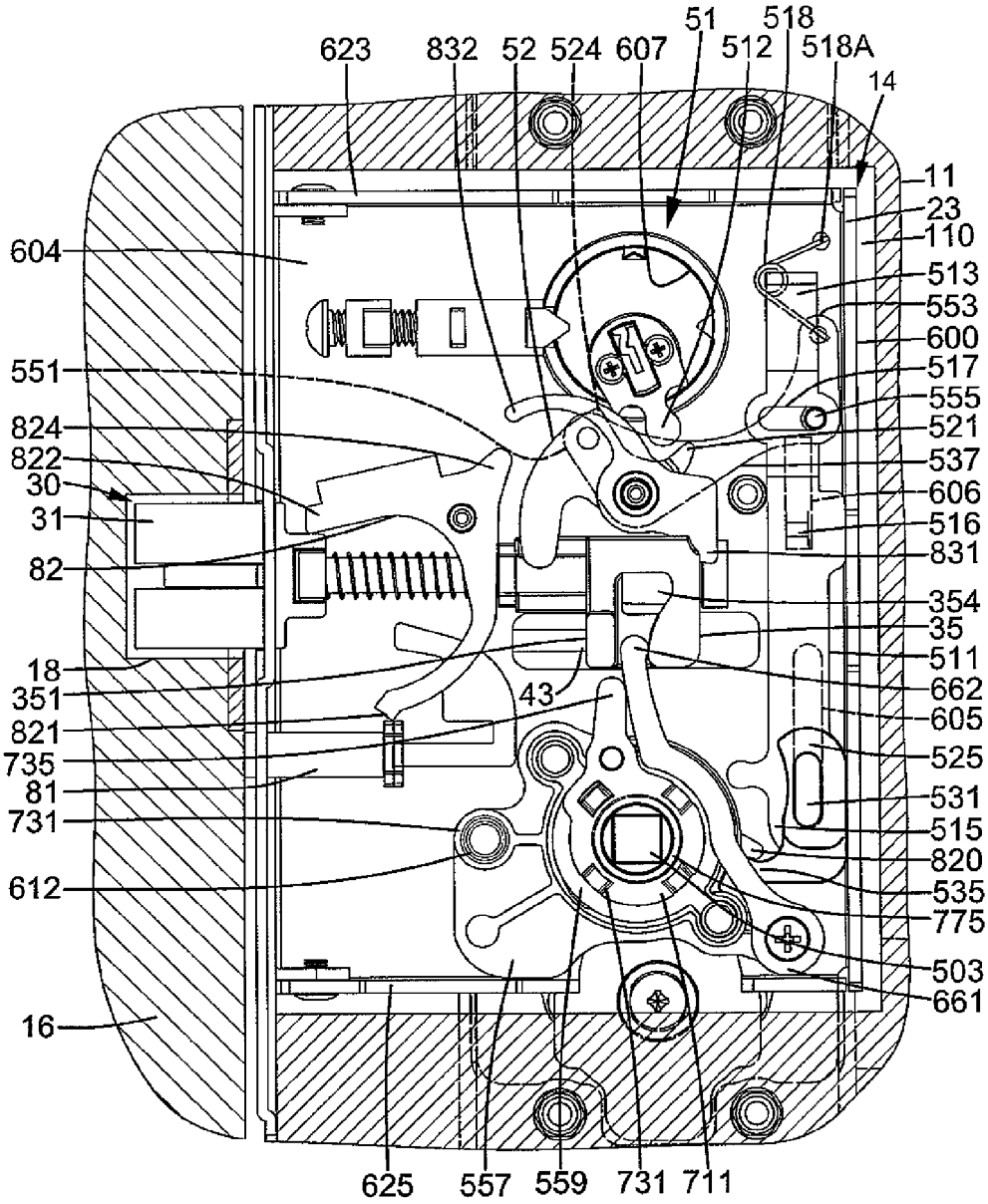
FIG. 6 is a cross sectional view similar to FIG. 4, with the door pivoted to a closed position.

Case 600 is mounted in a compartment 110 in an edge of a door 11 with faceplate 22 exposed and fixed to the edge of door 11. Door 11 includes outer and inner sides 13A and 13B. Compartment 110 is formed between and spaced from outer and inner sides 13A and 13B. Door 11 is pivotably mounted to a door frame 16. The door frame 16 includes a side having a latch hole 18 (FIG. 6).

According to the form shown, lid 24 includes a slot 242 extending from an outer face thereof through an inner face thereof along second axis Y. Lid 24 further includes a pivotal hole 246 extending from the outer face thereof through the inner face thereof and aligned with sleeve hole 622 along second axis Y. Pivotal hole 246 is spaced from and below slot 242 along third axis Z. Lid 24 further includes a limiting slot 244 between slot 242 and pivotal hole 246. A track 243 extends from the outer face of lid 24 through the inner face of lid 24. Screws 29 are extended through lid 24 into engagement pegs 612 to fix lid 24 and to form case 600.

Figure 10:
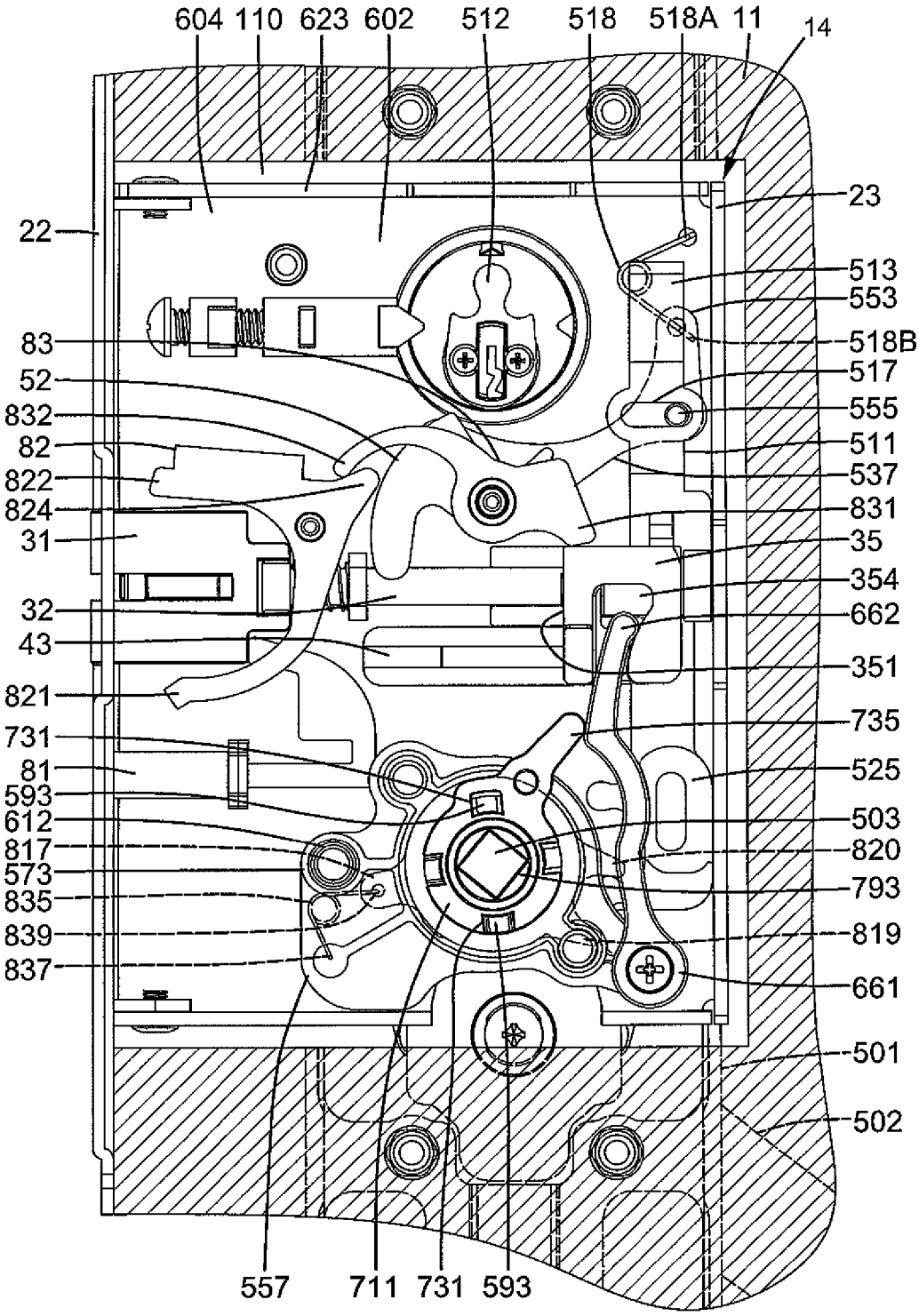
FIG. 10 is a view similar to FIG. 6, with the handle pivoted.

According to the form shown, latch device 14 further includes a latch bolt 30 having a shank 32 slideably received in space 602 along first axis X. A head 31 is connected to an outer end of shank 32 and extendible through first opening 221. A positioning plate 34 is slideably mounted around shank 32 along first axis X. A spring 33 is mounted between positioning plate 34 and head 31 and around shank 32. A retractor 35 is mounted on an inner end of shank 32 to move therewith and spaced from spring 33 by positioning plate 34. Retractor 35 includes an abutting face 351 facing head 31 and a sidewall 353 facing lid 24. A notch 354 is formed in sidewall 353. In the form shown, retractor 35 is slideably held between lateral wall 604 and lid 24. Thus, retractor 35 is slideable along first axis X between two positions (FIGS. 4 and 10) to cause movement of shank 32 and head 31 along first axis X, allowing movement of head 31 through first opening 221 between a latching position outside case 600 (FIG. 4) and an unlatching position inside case 600 (FIG. 10). Note that when latch bolt 30 is moving inward to the unlatching position, spring 33 is compressed, and retractor 35 is moved along first axis X.

According to the form shown, latch device 14 further includes an auxiliary bolt 81 that includes a positioning plate 814 having two sides fixed to lateral wall 604 and lid 24 for resiliently positioning auxiliary bolt 81 such that auxiliary bolt 81 is extendible through second opening 222 between an extended position (see FIG. 4) outside of case 600 and a retracted position (FIG. 6) inside case 600. Note that when head 31 of latch bolt 30 moves from the latching position to the unlatching position, auxiliary bolt 81 moves from the extended position to the retracted position.

According to the form shown, latch device 14 further includes a rocker 537 pivotably received in space 602. Rocker 537 includes a pivotal portion 539, a connection portion 551, and an end 553. A pin 555 is formed on a side of rocker 537 and located adjacent to end 553. Pivotal portion 539 is located between connection portion 551 and pin 555. Pivotal portion 539 of rocker 537 is pivotably mounted to first peg 614 of case 600. Connection portion 551 of rocker 537 is aligned with arcuate slot 635 of case 600. A first spring 518 is mounted between rocker 537 and case 600 and includes a first tang 518A attached to lateral wall 604 and a second tang 518B attached to end 553 of rocker 537.

Figure 7:
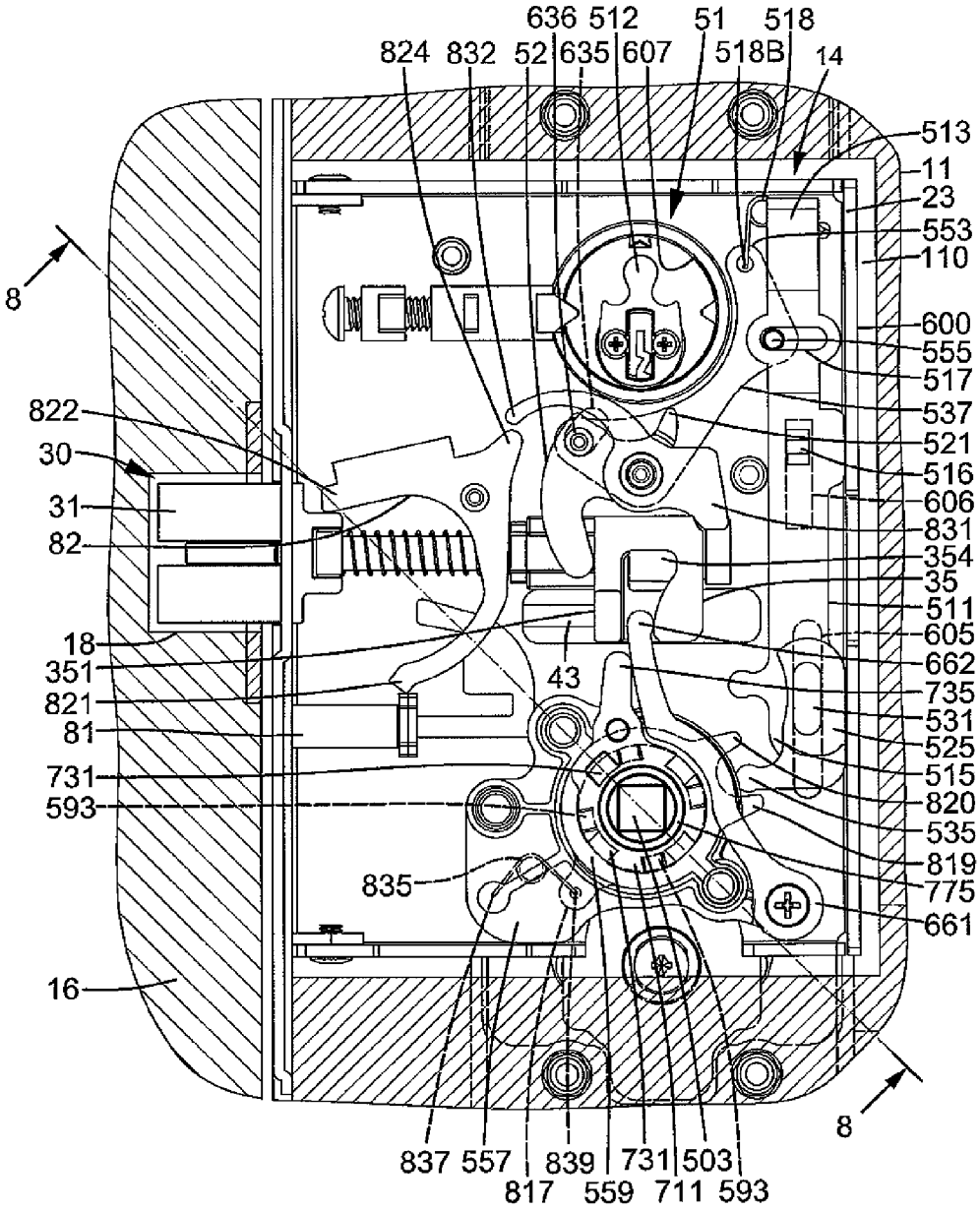
FIG. 7 is a view similar to FIG. 6, with the latch device in a locked state.

According to the form shown, latch device 14 further includes a follower 52 mounted in space 602. Follower 52 includes a push arm 522, a projection 521, and an engagement portion 524 located between the push arm 522 and the projection 521 in a circumferential direction about second axis Y. The engagement portion 524 includes a screw hole 523. Follower 52 is pivotably mounted to first peg 614 of case 600 and located between lateral wall 604 of case 600 and follower 52. Push arm 522 abuts abutting face 351 of retractor 35. A bolt 636 is extended through arcuate slot 635 of case 600 and connection portion 551 of rocker 537 into screw hole 523 of follower 52, allowing joint pivotal movement of rocker 537 and follower 52. Pivotal movement of follower 52 is limited by arcuate slot 635 of case 600 between a first position (FIG. 4) and a second position (FIG. 7). First spring 518 biases rocker 537 to one of the first and second positions.

According to the form shown, latch device 14 further includes an unlocking lever 83 mounted in space 602. Unlocking lever 83 includes first and second ends 831 and 832 and an intermediate portion between first and second ends 831 and 832. The intermediate portion of unlocking lever 83 is pivotably mounted to first peg 614. Follower 52 is located between rocker 537 and unlocking lever 83. Thus, unlocking lever 83 can pivot about second axis Y between a third position (FIG. 4) and a fourth position (FIG. 10). When unlocking lever 83 is in the third position, first end 831 is above second end 832 along third axis Z. On the other hand, when unlocking lever 83 is in the fourth position, first end 831 is below second end 832 along third axis Z. Furthermore, when head 31 of latch bolt 30 is in the latching position and when unlocking lever 83 is in the third position, first end 831 of unlocking lever 83 abuts sidewall 353 of retractor 35. When head 31 of latch bolt 30 moves from the latching position to the unlatching position, retractor 35 presses against first end 831 of unlocking lever 83, pivoting unlocking lever 83 from the third position to the fourth position.

Figure 4:
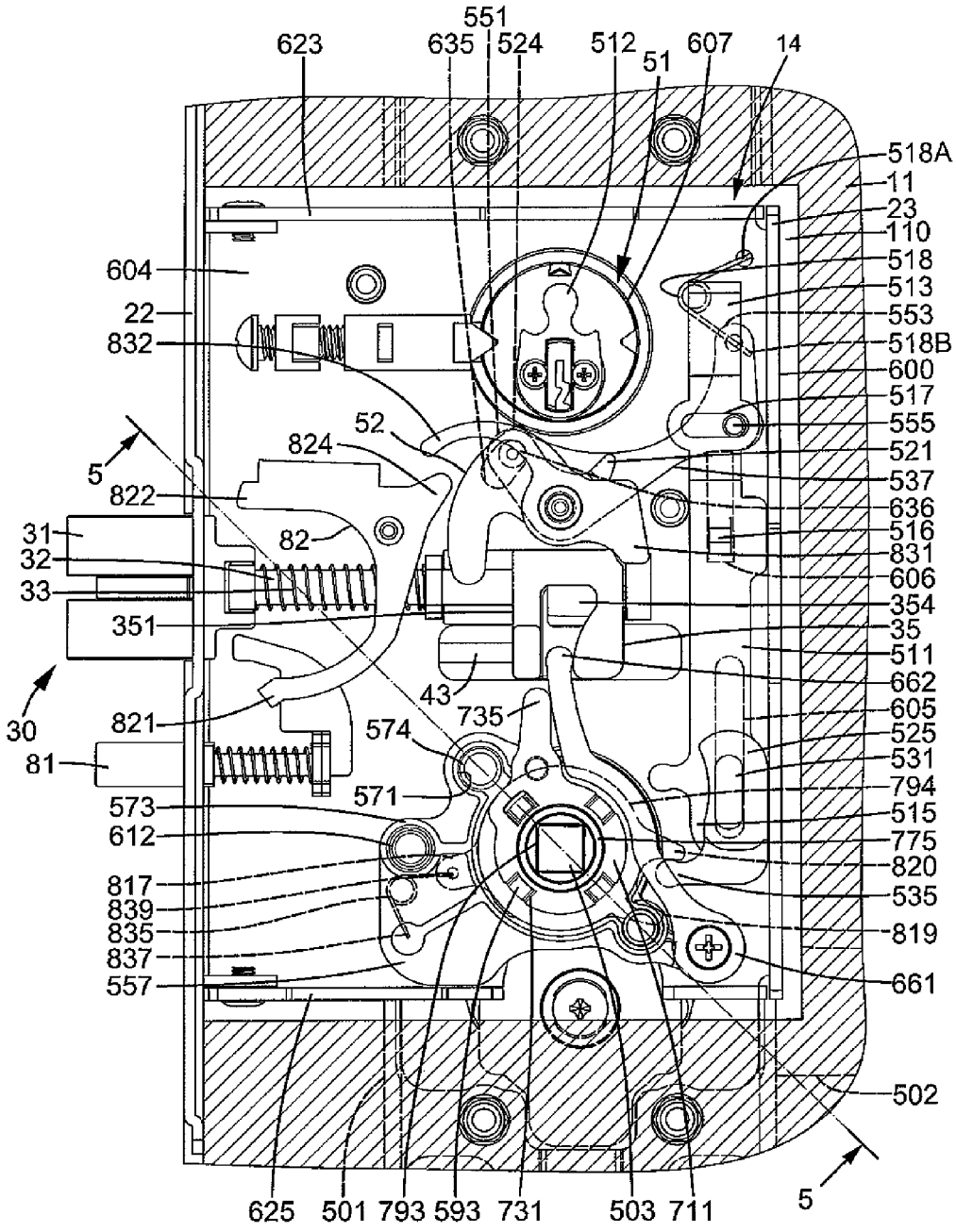
FIG. 4 shows a cross sectional view taken along section line 4-4 of FIG. 3.

According to the form shown, latch device 14 further includes a stop 82 mounted in space 602. Stop 82 includes a first end 821, a second end 822, and a protrusion 824 arranged similar to three apexes of a triangle. First end 821 is in the form of a hook. Stop 82 has a top portion 825 at second end 822. Stop 82 is mounted to third peg 618 and pivotable about second axis Y between a stop position (FIG. 6) and a release position (FIGS. 4 and 10). First end 821 of stop 82 is operatively connected to auxiliary bolt 81. Second end 832 of unlocking lever 83 abuts protrusion 824 of stop 82. When unlocking lever 83 is in the third position, second end 832 of unlocking lever 83 is spaced from protrusion 824 of stop 82. When unlocking lever 83 is in the fourth position, second end 832 of unlocking lever 83 presses against protrusion 824 of stop 82 to retain stop 82 in the release position.

According to the form shown, latch device 14 further includes a locking assembly 53 mounted in space 602. Locking assembly 53 includes a connection member 511 and a locking block 525. Connection member 511 includes an upper end 513 and a lower end 515. Connection member 511 further includes a slot 517 adjacent to upper end 513. An engagement groove 514 is formed in lower end 515. Connection member 511 further includes a protrusion 516 on a face thereof extending between upper and lower ends 513 and 515. Protrusion 516 is located between slot 517 and engagement groove 514 along third axis Z. Locking block 525 includes first and second faces 527 and 529 spaced from each other along second axis Y. A stub 531 is formed on first face 527. An engagement block 533 is formed on second face 529. Locking block 525 further includes a leg 535.

Protrusion 516 of connection member 511 is slideably received in second guiding slot 606 of case 600. Pin 555 of rocker 537 is slideably received in slot 517 of connection member 511. Engagement block 533 of locking block 525 extends through engagement groove 514 of connection member 511 and is slideably received in first guiding groove 605 of case 600. Stub 531 of locking block 525 is slideably received in track 243 of lid 24. Thus, locking assembly 53 is slideable along the third axis Z between an upper position (FIG. 7) and a lower position (FIGS. 4, 6, and 10) and limited by the first and second guiding slots 605 and 606 and track 243. When follower 52 pivots between the first and second positions, rocker 537 pivots and causes movement of locking assembly 53 between the upper and lower positions.

According to the form shown, latch device 14 further includes a seat 557 mounted in space 602. Seat 557 includes first and second sides 558 and 560 spaced from each other along second axis Y. A substantially C-shaped face 561 is located between first and second sides 558 and 560 along second axis Y. A receiving hole 559 extends from first side 558 through second side 560. Two receiving grooves 571 are formed in an inner periphery of receiving hole 559 and diametrically opposed to each other. Two barrels 573 are formed on an outer periphery of seat 557 extending between first and second sides 558 and 560. One of barrels 573 engages with one of engagement pegs 612 of case 600. The other barrel 573 engages with second peg 616 of case 600. Receiving hole 559 of seat 557 is aligned with sleeve hole 622 of case 600 and pivotal hole 246 of lid 24. First side 558 of seat 557 abuts the inner face of lid 24. Second side 560 of seat 557 abuts lateral wall 604 of case 600.

According to the form shown, latch device 14 further includes a driving rod 66 having a pivotal end 661 pivotably mounted to second peg 616 and an actuation end 662 engaged in notch 354 of retractor 35. Retractor 35 is moved to retract head 31 of latch bolt 30 when driving rod 66 pivots about second axis Y.

According to the form shown, latch device 14 further includes a push block 794 pivotably mounted to seat 557.

Push block 794 includes an inner face 795 and an outer face 797 spaced from inner face 795 along second axis Y. Push block 794 further includes an axial hole 815 extending from inner face 795 through outer face 797. Three push portions 799 are formed on inner face 795. Each push portion 799 is in the form of a ratchet tooth. Each push portion 799 includes a push wall 811 at an obtuse angle to inner face 795 and a stop wall 813 substantially perpendicular to inner face 795. Push block 794 further includes first and second legs 819 and 820 and a lug 817 on an outer periphery thereof. Push block 794 is located between second side 560 of seat 557 and lateral wall 604 of case 600. Leg 535 of locking block 525 is located between first and second legs 819 and 820 of push block 794. Push block 794 is received in receiving hole 559 of seat 557 and pivotable between an engagement position (FIGS. 4 and 5) and a disengagement position (FIGS. 7 and 8) relative to seat 557. Push block 794 is in the disengagement position when locking assembly 53 is in the upper position. Push block 794 is in the engagement position when locking assembly 53 is in the lower position.

A second spring 835 is mounted between push block 794 and case 600. Second spring 835 includes a first tang 837 attached to seat 557 and a second tang 839 attached to lug 817. Second spring 835 biases push block 794 in one of the engagement position and the disengagement position.

Figure 5:
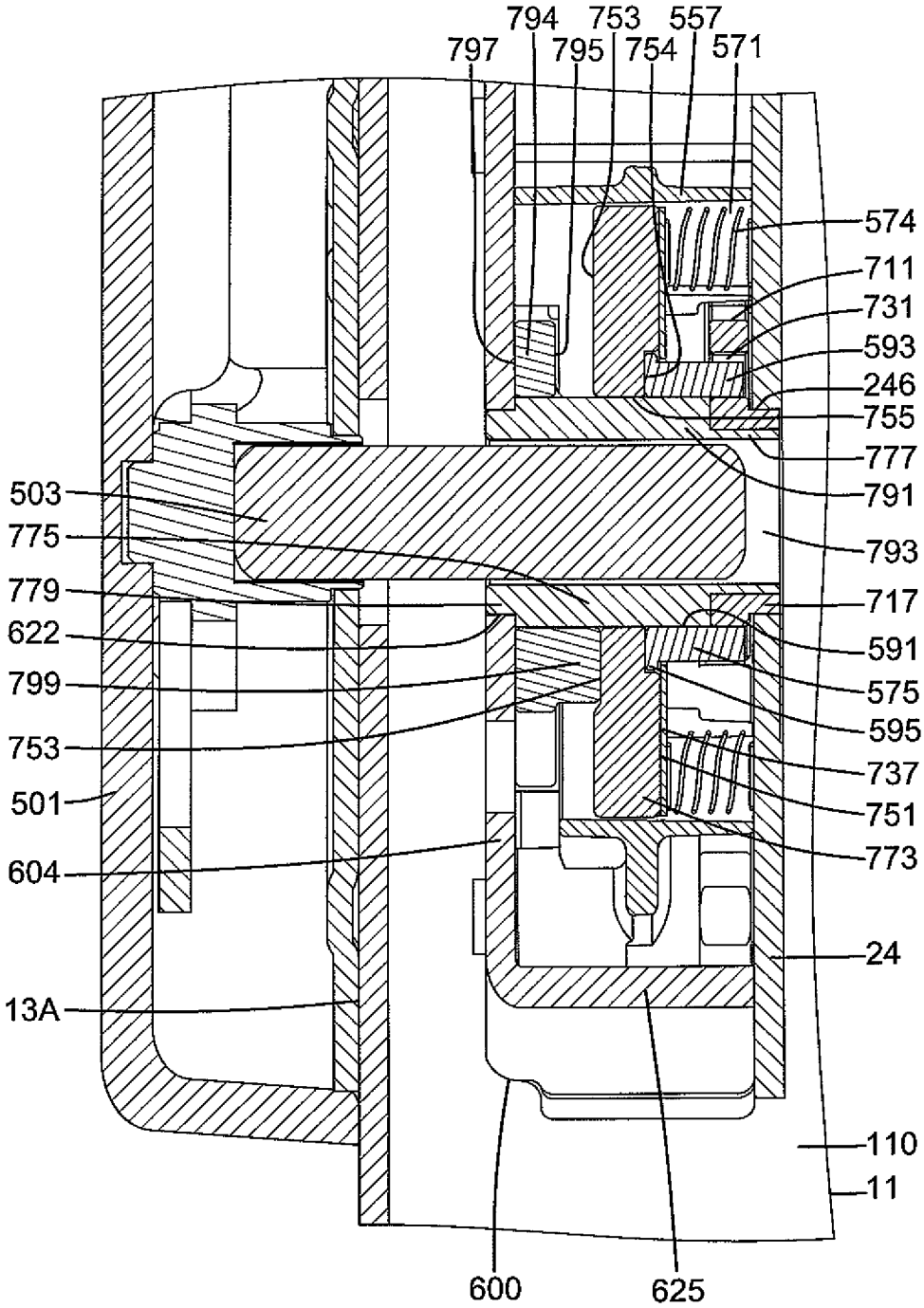
FIG. 5 shows a cross sectional view taken along section line 5-5 of FIG. 4.
Figure 8:
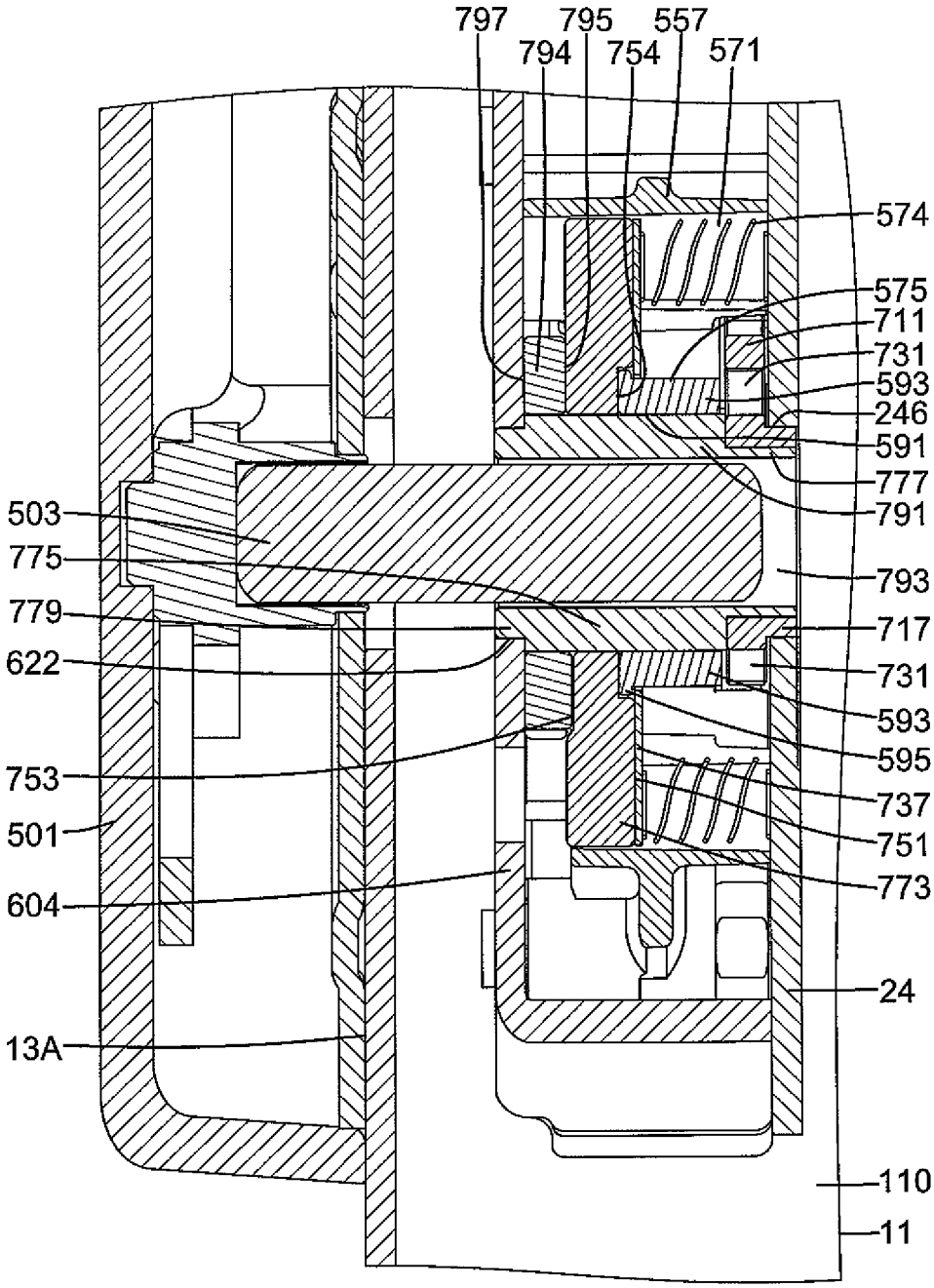
FIG. 8 shows a cross sectional view taken along section line 8-8 of FIG. 7.

According to the form shown, latch device 14 further includes a sliding block 739 slideably received in receiving hole 559 of seat 557. Sliding block 739 includes first and second faces 751 and 753. Three engagement portions 757 are formed on second face 753 of sliding block 739. Each engagement portion 757 is in the form of a groove complimentary to one of push portions 799 of push block 794. Each engagement portion 757 of sliding block 739 includes a push face 759 at an obtuse angle to second face 753 and a stop face 771 substantially perpendicular to second face 753. Sliding block 739 further includes two sliding ears 773 on an outer periphery thereof. A recessed portion 754 extends from first face 751 towards second face 753 but spaced from second face 753 of sliding block 739. A through-hole 755 extends from a bottom wall of recessed portion 754 through second face 753 of sliding block 739 along second axis Y. Each sliding ear 773 of sliding block 739 is slideably received in one of receiving grooves 571 of seat 557. Sliding block 739 is slideable along second axis Y between a front position (FIG. 5) and a rear position (FIG. 8). Second face 753 of sliding block 739 is spaced from inner face 795 of push block 794 along second axis Y when sliding block 739 is in the front position (FIG. 5). Through-hole 755 of sliding block 739 is aligned with axial hole 815 of push block 794. Each engagement portion 757 of sliding block 739 faces one of push portions 799 of push block 794. Second face 753 of sliding block 739 abuts inner face 795 of push block 794 when sliding block 739 is in the rear position (FIG. 8).

A gasket 737 is mounted to first face 751 of sliding block 739 and has cross sections similar to sliding block 739. A spring 574 is mounted in each receiving groove 571 and located between gasket 737 and lid 24 along second axis Y. Springs 574 bias push block 794 against gasket 737.

According to the form shown, latch device 14 further includes a clutch 575 jointly movable with sliding block 739. Clutch 575 includes first and second sides 577 and 579 spaced from each other along second axis Y. Four insertion blocks 593 are formed on first side 577 of clutch 575. A flange 595 is formed on an outer periphery of clutch 575 extending between first and second sides 577 and 579. An actuation hole 591 extends from first side 577 through second side 579 of clutch 575 along second axis Y and has non-circular cross sections. Flange 595 of clutch 575 is engaged in recessed portion 754 of sliding block 739 and located between the bottom wall of recessed portion 754 of sliding block 739 and gasket 737 (FIG. 5). Clutch 575 and sliding block 739 are jointly movable between the front position and the rear position along second axis Y.

According to the form shown, latch device 14 further includes an unlatching member 711 pivotably connected to lid 24. Unlatching member 711 includes outer and inner sides 713 and 715 spaced from each other along second axis Y. A pivotal portion 717 is formed on outer side 713 of unlatching member 711. Four insertion grooves 731 extend from outer side 713 through inner side 715 along second axis Y. A pivotal hole 719 extend from a face of pivotal portion 717 through inner side 715 along second axis Y. A push leg 735 is formed on an outer periphery of unlatching member 711. A limiting rod 733 is formed on outer side 713. Unlatching member 711 is located between lid 24 and face 561 of seat 557. Pivotal portion 717 of unlatching member 711 is pivotably received in pivotal hole 246 of lid 24, with pivotal hole 719 aligned with pivotal hole 246. Limiting rod 733 of unlatching member 711 is slideably received in limiting slot 244 of lid 24 that limits pivotal movement of unlatching member 711. Push leg 735 abuts a side of driving rod 66. When sliding block 739 is in the front position, insertion blocks 593 of clutch 575 engage with insertion grooves 731 of unlatching member 711 (FIG. 5), allowing joint movement of clutch 575 and unlatching member 711. When sliding block 739 is in the rear position, insertion blocks 593 of clutch 575 disengage from insertion grooves 731 of unlatching member 711 (FIG. 8), not allowing joint movement of clutch 575 and unlatching member 711. Thus, when unlatching member 711 pivots while sliding block 739 is in the front position, push leg 735 presses against driving rod 66, moving head 31 of latch bolt 30 from the latching position (FIG. 4) to the unlatching position (FIG. 10).

According to the form shown, latch device 14 further includes a sleeve 775 mounted to clutch 575 to rotate jointly with clutch 575. Sleeve 775 includes first and second sections 777 and 779 spaced from each other along second axis Y and an intermediate portion 791 between the first and second sections 777 and 779. Intermediate portion 791 has non-circular cross sections. A coupling hole 793 extends from first section 777 through second section 779 and has non-circular cross sections. Second section 779 of sleeve 775 is pivotably received in sleeve hole 622 of case 600. Intermediate portion 791 is pivotably received in axial hole 815 of push block 794 and through-hole 755 of sliding block 739. Intermediate portion 791 of sleeve 775 is engaged in actuation hole 591 of clutch 575, allowing joint pivotal movement of clutch 575 and sleeve 775. First section 777 of sleeve 775 is pivotably received in pivotal hole 719 of unlatching member 711. Clutch 575 is pivoted when sleeve 775 pivots, but push block 794, sliding block 739, and unlatching member 711 are not moved.

Latch device 14 can be driven by an inner operational device 4 mounted to inner side 13B of door 11 and an outer operational device 12 mounted to outer side 13A of door 11. Inner operational device 4 includes a housing 41, a pressing bar 42, and a driving bar 43 operatively connected to pressing bar 42. An end of driving bar 43 extends through door 11 and slot 242 of lid 24 into space 602 and abuts abutting face 351 of retractor 35. When pressing bar 42 is pressed, retractor 35 is moved by driving bar 43, moving head 31 of latch bolt 30 from the latching position to the unlatching position.

Outer operational device 12 includes a housing 501 fixed to outer side 13A of door 11. A handle 502 is pivotably mounted to housing 501. A liking rod 503 is pivotably mounted in housing 501 and jointly movable with handle 502. Linking rod 503 extends through door 11 and case 600 and engages with coupling hole 793 of sleeve 775. When handle 502 pivots, linking rod 503, sleeve 775, and clutch 575 pivot jointly. Outer operational device 12 further includes a cylinder 51 mounted to housing 501. Cylinder 51 includes an actuating plate 512 jointly pivotable with a key-operable lock core in cylinder 51. Cylinder 51 extends through door 11 and mounting hole 607 of case 600 into space 602. Actuating plate 512 is located above follower 52 along third axis Z. When actuating plate 512 pivots and, thus, presses against projection 521 or engagement portion 524 of follower 52, follower 52 pivots between the first and second positions.

Now that the basic construction of latch device 14 has been explained, the operation and some of the advantages of latch device 14 can be set forth and appreciated. In particular, for the sake of explanation, it will be assumed that door 11 is open (FIG. 4), head 31 of latch bolt 30 is in the latching position, auxiliary bolt 81 is in the extended position. Furthermore, unlocking lever 83 is in the third position, and stop 82 is in the release position. Second end 822 of stop 82 is located outside of the path between the latching position and the unlatching position of head 31 of latch bolt 30, allowing movement of head 31 of latch bolt 30 from the latching position to the unlatching position. Further, follower 52 is in the first position, and locking assembly 53 is in the lower position. Push portions 799 of push block 794 are misaligned from engagement portions 757 of sliding block 739 and presses against second face 753 of sliding block 739, such that sliding block 739 presses against springs 574 to maintain in the front position (FIG. 5). Insertion blocks 593 of clutch 575 are engaged with insertion grooves 731 of unlatching member 711. In this case, latch device 14 is in an unlocked state. Head 31 of latch bolt 30 can be unlatched by either operating handle 502 or pressing bar 42.

When door 11 is pivoted from the open position (FIG. 4) to a closed position while latch device 14 is in the unlocked state, head 31 of latch bolt 30 is pressed against by door frame 16 and moves from the latching position to the unlatching position, and spring 33 is compressed. Auxiliary bolt 81 moves from the extended position to the retracted position while head 31 moves to the unlatching position. When door 11 reaches the closed position (FIG. 6), head 31 of latch bolt 30 is biased by spring 33 from the unlatching position to the latching position and engages with latch hole 18 of door frame 16, retaining door 11 in the closed position. Auxiliary bolt 81 is pressed against by door frame 16 and retained in the retracted position. Stop 82 pivots from the release position to the stop position under the gravitational force, such that second end 822 of stop 82 is located in the path of head 31 of latch bolt 30 between the latching and unlatching positions. Thus, head 31 of latch bolt 30 can not be picked via a gap between door 11 and door frame 16.

Figure 9:
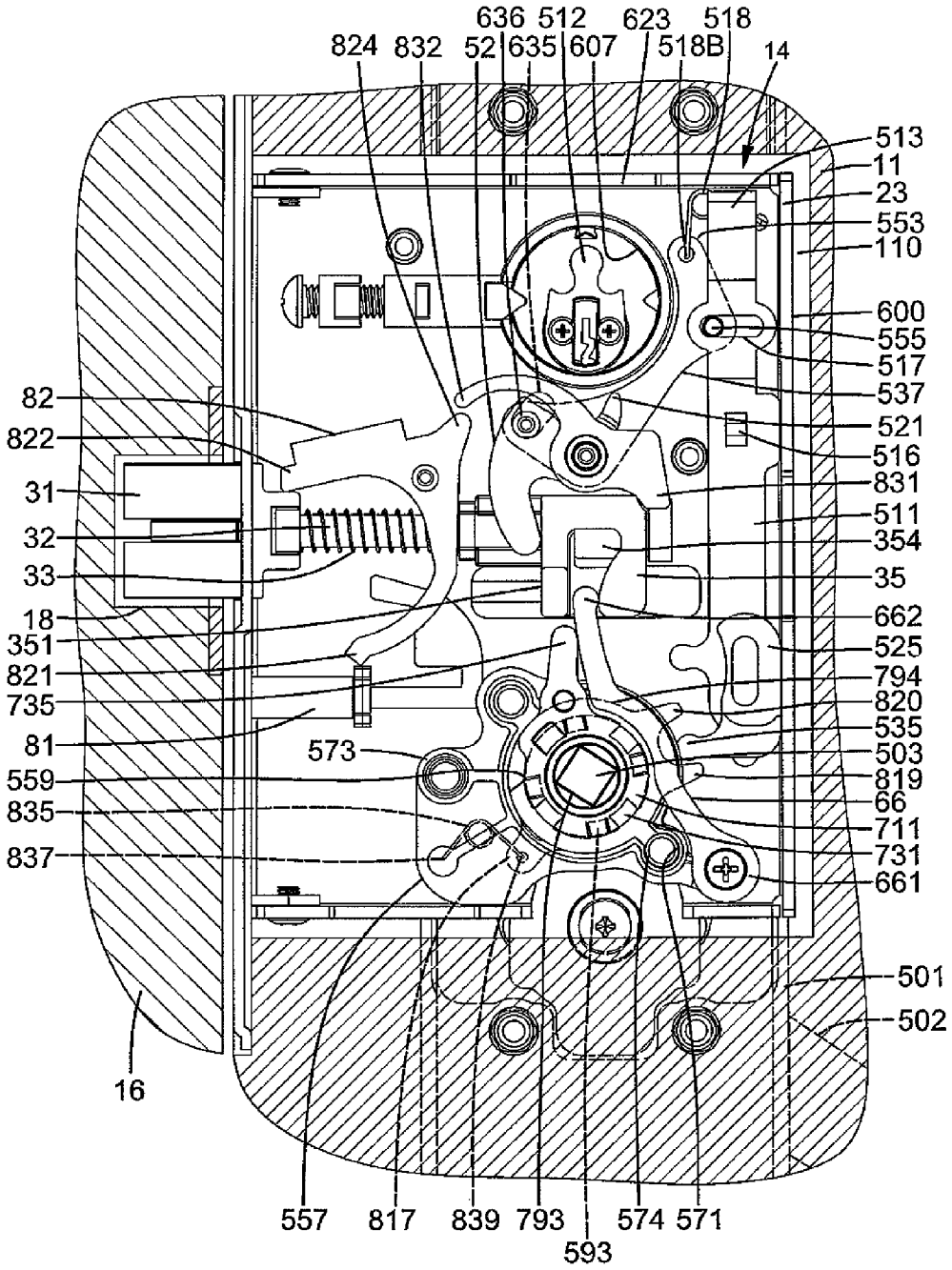
FIG. 9 is a view similar to FIG. 7, with an outer handle of the outer operational device pivoted.

When door 11 is in the closed position and latch device 14 is in the unlocked state (FIG. 6), if a key is used to pivot the lock core of cylinder 51 of outer operational device 12 in a direction, actuating plate 512 of cylinder 51 pivots and presses against engagement portion 524 of follower 52, causing joint pivotal movement of rocker 537 and follower 52 from the first position to the second position. Rocker 537 causes movement of locking assembly 53 from the lower position (FIG. 6) to the upper position (FIG. 7). Leg 535 of locking block 525 presses against second leg 820 of push lock 794, pivoting push block 794 from the engagement position (FIGS. 5 and 6) to the disengagement position (FIGS. 7 and 8). Thus, push portions 799 of push block 794 are aligned with engagement portions 757 of sliding block 739. Springs 574 bias sliding block 739 to the rear position (FIG. 8), causing engagement of push portions 799 of push block 794 and engagement portions 757 of sliding block 739. Push wall 811 of each push portion 799 abuts push face 759 of one of engagement portions 757. Stop wall 813 of each push portion 799 abuts stop face 771 of one of engagement portions 757. Insertion blocks 593 of clutch 575 disengage from insertion grooves 731 of unlatching member 711 (FIG. 8). Thus, latch device 14 is in a locked state. In this case, unlatching member 711 is not pivoted when handle 502 of outer operational device 12 is pivoted (FIG. 9). However, if pressing bar 42 of inner operational device 4 is pressed, head 31 of latch bolt 30 moves to the unlatching position because retractor 35 is moved by driving bar 43. Each push portion 799 of push block 794 is in the form of a ratchet tooth such that push block 794 can only pivot towards push face 759 of each engagement portion 757 of sliding block 739. Namely, pivotal movement of push block 794 towards stop face 771 of each engagement portion 757 is not allowed.

When door 11 is in the closed position and latch device 14 is in the locked state (FIG. 7), if it is desired to open door 11 by outer operational device 12, the key is used to pivot actuating plate 512 of cylinder 51 in a reverse direction, which, in turn, presses against projection 521 of follower 52, moving follower 52 from the second position (FIG. 7) to the first position (FIG. 4). Locking assembly 53 returns to the lower position. Leg 535 of locking block 525 presses against first leg 819 of push block 794, moving push block 794 from the disengagement position to the engagement position. Push wall 811 of each push portion 799 of push block 794 presses against push face 759 of each engagement portion 757 of sliding block 739, moving sliding block 739 from the rear position (FIG. 8) to the front position (FIG. 5). Insertion blocks 593 of clutch 575 engage with insertion grooves 731 of unlatching member 711, allowing joint movement of clutch 575 and unlatching member 711. Thus, latch device 14 is in the unlocked state. In this case, if handle 502 is pivoted to cause joint pivotal movement of sleeve 775 and linking rod 503 (FIG. 10), linking rod 503 pivots clutch 575 to push driving rod 66 via pivotal movement of unlatching member 711. Actuation end 662 of driving rod 66 pushes retractor 35 to retract head 31 of latch bolt 30 to the unlatching position. First end 831 of unlocking lever 83 is pressed against by retractor 35, and unlocking lever 83 pivots from the third position to the fourth position. Second end 832 of unlocking lever 83 presses against protrusion 824 of stop 82, pivoting stop 82 from the stop position to the release position. In this case, door 11 can be moved from the closed position to the open position.

When door 11 reaches the open position and handle 502 is released, spring 33 biases head 31 of latch bolt 30 to the latching position. Auxiliary bolt 81 is not pressed against by door frame 16 and returns to the extended position. Stop 82 returns to the release position under the action of auxiliary bolt 81. Unlocking lever 83 is not pressed against by retractor 35 and moves to the third position (FIG. 4) under the action of gravitational force.

Latch device 14 uses pivotal movement of push block 794 to change the relative position between sliding block 739 and clutch 575, selectively engaging or disengaging clutch 575 with or from unlatching member 711. When unlatching member 711 is disengaged from clutch 575, head 31 of latch bolt 30 can not be refracted when handle 502 of outer operational device 12 is pivoted. Namely, handle 502 rotates freely without causing damage to the components of latch device 14 when latch device 14 is in the locked state.

Now that the basic teachings of the present invention have been explained, many extensions and variations will be obvious to one having ordinary skill in the art. For example, push block 794 can include only one push portion 799, and sliding block 739 can include only one engagement portion 757. Furthermore, sliding block 739 does not have to include sliding ears 773, and seat 557 does not have to include receiving grooves 571. The outer periphery of sliding block 739 can include non-circular cross sections, with sliding block 739 slideably received in receiving hole 559 of seat 557, and with springs 574 mounted in receiving hole 559 of seat 557 and located around clutch 575. In this case, when sliding block 739 is in the front position, springs 574 bias sliding block 739 rearward, causing joint movement of clutch 575 and sliding block 739 from the front position to the rear position. Furthermore, leg 535 of locking block 525 can be directly formed on lower end 515 of connection member 511, and leg 535 on connection member 511 is located between first and second legs 819 and 820 of push block 794. In this case, when locking assembly 53 moves between the upper and lower positions, push block 794 moves between the engagement position and the disengagement position. Further, locking assembly 53 dose not have to include stub 531, and push block 794 does not have to include first and second legs 819 and 820. In this case, lower end 515 of connection member 511 can be pivotably connected to push block 794, such that push block 794 pivots between the engagement position and the disengagement position when connection member 511 moves along third axis Z.

Furthermore, latch device 14 does not have to include springs 574. In this case, push block 794 and sliding block 739 can be magnetic to attract each other. When push block 794 pivots from the disengagement position to the engagement position, sliding block 739 moves from the front position to the rear position under magnetic attraction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch device comprising:

a case (600) adapted to be mounted in a compartment (110) in a door (11), with the case (600) including a lateral wall (604) and a space (602) delimited by the lateral wall (604), with a first peg (614) and a second peg (616) formed on the lateral wall (604) and located in the space (602), with the lateral wall (604) further including a sleeve hole (622) located between the first and second pegs (614, 616);

a latch bolt (30) received in the space (602), with the latch bolt (30) including a refractor (35) and a head (31) operatively connected to the retractor (35), with the head (31) slideable along a first axis (X) between a latching position outside of the case (600) and an unlatching position in the case (600), with the head (31) biased from the unlatching position to the latching position;

a rocker (537) including a pivotal portion (539) and a connection portion (551), with the rocker (537) further including a pin (555), with the pivotal portion (539) located between the pin (555) and the connection portion (551), with the pivotal portion (539) of the rocker (537) pivotably mounted to the first peg (614) of the case (600);

a follower (52) pivotably connected to the first peg (614) of the case (600), with the follower (52) including a projection (521) and an engagement portion (524), with the connection portion (551) of the rocker (537) pivotably connected to the engagement portion (524) of the follower (52), with the follower (52) pivotable between a first position and a second position about a second axis (Y) perpendicular to the first axis (X), with the follower (52) adapted to be driven by an actuating plate (512) of a cylinder (51) of an outer operational device (12) mounted to an inner side (13B) of the door (11), with the follower (52) pivoting between the first and second positions when the actuating plate (512) presses against the projection (521) or the engagement portion (524);

a connection member (511) slideably received in the space (602) of the case (600), with the connection member (511) including upper and lower ends (513, 515) spaced from each other along a third axis (Z) perpendicular to the first and second axes (X, Y), with the connection member (511) further including a slot (517) between the upper and lower ends (513, 515), with the pin (555) of the rocker (537) slideably received in the slot (517) of the connection member (511), with the connection member (511) moving between an upper position and a lower position along the third axis (Z) when the rocker (537) pivots;

a seat (557) mounted in the space (602) of the case (600), with the seat (557) including first and second sides (558, 560) spaced from each other along the second axis (Y), with a receiving hole (559) extending from the first side (558) through the second side (560) of the seat (557), with the receiving hole (559) of the seat (557) aligned with the sleeve hole (622) of the case (600);

a push block (794) including inner and outer faces (795, 797) spaced from each other along the second axis (Y), with an axial hole (815) extending from the inner face (795) through the outer face (797) of the push block (794), with a push portion (799) formed on the inner face (795) of the push block (794), with the push block (794) located between the seat (557) and the lateral wall (604) of the case (600), with the axial hole (815) of the push block (794) aligned with the sleeve hole (622) of the case (600), with the push block (794) pivotable between an engagement position and a disengagement position when the connection member (511) moves between the upper and lower positions;

a sliding block (739) slideably received in the receiving hole (559) of the seat (557), with the sliding block (739) including first and second faces (751, 753) spaced from each other along the second axis (Y), with an engagement portion (757) formed on the second face (753) of the sliding block (739), with the engagement portion (757) of the sliding block (739) engaged with the push portion (799) of the push block (794), with the sliding block (739) movable between a front position and a rear position along the second axis (Y), with the sliding block (739) being in the rear position when the push block (794) is in the disengagement position, with the sliding block (739) being in the front position when the push block (794) is in the engagement position;

a clutch (575) received in the receiving hole (559) of the seat (557) and releasably engaged with the sliding block (739), with the clutch (575) including first and second sides (577, 579) spaced from each other along the second axis (Y), with an actuation hole (591) extending from the first side (577) through the second side (579) of the clutch (575);

an unlatching member (711) including outer and inner sides (713, 715) spaced from each other along the second axis (Y), with an insertion groove (731) extending from the outer side (713) through the inner side (715) of the unlatching member (711), with a pivotal hole (719) extending from the outer side (713) through the inner side (715) of the unlatching member (711), with the unlatching member (711) further including an outer periphery extending between the outer and inner sides (713, 715) of the unlatching member (711), with a push leg (735) formed on the outer periphery of the unlatching member (711), with the insertion block (593) of the clutch (575) engaged with the insertion groove (731) of the unlatching member (711) when the sliding block (739) is in the front position, with the insertion block (593) of the clutch (575) disengaged from the insertion groove (731) of the unlatching member (711) when the sliding block (739) is in rear position;

a sleeve (775) engaged with and jointly pivotable with the clutch (575), with the sleeve (775) including first and second sections (777, 779) spaced from each other along the second axis (Y) and an intermediate portion (791) between the first and second sections (777, 779), with the second section (779) of the sleeve (775) pivotably received in the sleeve hole (622) of the case (600), with the intermediate portion (791) of the sleeve (775) pivotably received in the axial hole (815) of the push block (794) and the through-hole (755) of the sliding block (739), with the intermediate portion (791) of the sleeve (775) engaged with the actuation hole (591) of the clutch (575) to allow joint pivotal movement of the sleeve (775) and the clutch (575), with the first section (777) of the sleeve (775) pivotably connected to the unlatching member (711), with the sleeve (775) adapted to be operatively connected to a linking rod (503) of an outer operational device (12) mounted to an outer side (13A) of the door (11), with the outer operational device (12) having a handle (502), with the sleeve (775) adapted to pivot through transmission by the linking rod (503) when the handle (502) pivots;

a driving rod (66) pivotably received in the space (602) and including an actuation end (662) operatively connected to the retractor (35), with the driving rod (66) further including a pivotal end (661) pivotably mounted to the second peg (616) of the case (600), with the push leg (735) of the unlatching member (711) abutting the driving rod (66), with the driving rod (66) pushed by the push leg (735) to move the retractor (35) when the unlatching member (711) pivots;

with the follower (52) in the first position, the connection member (511) is in the lower position, the push block (794) is in the engagement position, the sliding block (739) is in the front position, the insertion block (593) of the clutch (575) engages with the insertion groove (731) of the unlatching member (711), when the sleeve (775) pivots and causes pivotal movement of the unlatching member (711), the driving rod (66) pivots to retract the retractor (35), moving the head (31) of the latch bolt (30) from the latching position to the unlatching position, and with the follower (52) in the second position, the connection member (511) is in the upper position, the push block (794) is in the disengagement position, the sliding block (739) is in the rear position, the insertion block (593) of the clutch (575) disengages from the insertion groove (731) of the unlatching member (711), the unlatching member (711) is not moved when the sleeve (775) pivots, retaining the head (31) of the latch bolt (30) in the latching position.

2. The latch device as claimed in claim 1, further comprising: a locking block (525) fixed to the lower end (515) of the connection block (511), with the locking block (525) including a push leg (535), with the push block (794) further including an outer periphery extending between the inner and outer faces (795, 797) of the push block (794), with first and second legs (819, 820) formed on the outer periphery of the push block (794), with the push leg (535) of the locking block (525) located between the first and second legs (819, 820) of the push block (794), wherein when the connection member (511) moves from the lower position to the upper position, the push leg (535) of the locking block (525) presses against the second leg (820) of the push block (794), pivoting the push block (794) from the disengagement position to the engagement position, and wherein when the connection member (511) moves from the upper position to the lower position, the push leg (535) of the locking block (525) presses against the first leg (819) of the push block (794), pivoting the push block (794) from the engagement position to the disengagement position.

3. The latch device as claimed in claim 1, with the case (600) further including a lid (24) spaced from the lateral wall (604) along the second axis (Y), with the space (602) defined between the lid (24) and the lateral wall (604), with the seat (557) further including a receiving groove (571) in an inner periphery of the receiving hole (559) of the seat (557), with a sliding ear (773) formed on an outer periphery of the sliding block (739), with the sliding ear (773) slideably received in the receiving groove (571) of the seat (557), preventing the sliding block (739) from pivoting about the first axis (X) relative to the seat (557), with a spring (574) mounted in the receiving groove (571) of the seat (557) and located between the sliding ear (773) of the sliding block (739) and the lid (24), with the spring (574) biasing the sliding block (739) from the front position to the rear position.

4. The latch device as claimed in claim 3, with the push portion (799) of the push block (794) being a ratchet tooth including a push wall (811), with the engagement portion (757) of the sliding block (739) being a groove complimentary to the ratchet tooth, with the engaging portion (757) including a push face (759), wherein when the push block (794) is in the disengagement position, the push portion (799) of the push block (794) is aligned with the engagement portion (757) of the sliding block (739), the sliding block (739) is biased by the spring (574) to move from the front position to the rear position, the push wall (811) of the push portion (799) of the push block (794) abuts the push face (759) of the engagement portion (757) of the sliding block (739), and with the sliding block (739) in the rear position, when the push block (794) pivots from the disengagement position to the engagement position, the push wall (811) of the push portion (799) of the push block (794) presses against the push face (759) of the engagement portion (757) of the sliding block (739), moving the sliding block (739) from the rear position to the front position.

5. The latch device as claimed in claim 1, with the seat (557) further including a face (561) between the first and second sides (558, 560) of the seat (557), with the face (561)

being substantially C-shaped, with the inner side (715) of the unlatching member (711) abutting the face (561) of the seat (557).

* * * * *